United States Patent [19]

Hebert

[11] Patent Number: 4,755,068

[45] Date of Patent: Jul. 5, 1988

[54] DOT MATRIX PRINT HEAD ASSEMBLY

[75] Inventor: Donald G. Hebert, Alamo, Calif.

[73] Assignee: DH Technology, Inc., San Diego, Calif.

[21] Appl. No.: 8,825

[22] Filed: Jan. 30, 1987

[51] Int. Cl.[4] ..... B41J 3/12

[52] U.S. Cl. ..... 400/124; 101/93.05; 335/282

[58] Field of Search ..... 400/124; 101/93.05; 335/279, 282; 336/65, 90

[56] References Cited

U.S. PATENT DOCUMENTS

| | | | |
|---|---|---|---|
| 3,897,865 | 8/1975 | Darwin et al. | 197/1 R |
| 3,921,780 | 11/1975 | Gentzlinger et al. | 197/1 R |
| 3,929,214 | 12/1975 | Hebert | 197/1 R |
| 4,214,836 | 7/1980 | Wang | 400/124 |
| 4,244,658 | 1/1981 | Mori | 400/124 |
| 4,259,653 | 3/1981 | McGonigal | 335/230 |
| 4,265,549 | 5/1981 | Cote | 400/124 |
| 4,284,363 | 8/1981 | Choberka et al. | 400/124 |
| 4,396,304 | 8/1983 | Davenport et al. | 400/124 |
| 4,452,542 | 6/1984 | Akazawa | 400/175 |
| 4,484,170 | 11/1984 | Wirth | 400/124 X |
| 4,490,057 | 12/1984 | Reece | 400/124 |
| 4,521,122 | 6/1985 | Schafer | 400/124 |
| 4,525,085 | 6/1985 | Akazawa | 400/59 |
| 4,569,605 | 2/1986 | Meier | 400/124 |
| 4,653,943 | 3/1987 | Sakaida | 400/124 |
| 4,661,002 | 4/1987 | Ara | 400/124 |

*Primary Examiner*—Paul T. Sewell
*Attorney, Agent, or Firm*—Klaas & Law

[57] ABSTRACT

A dot matrix print head assembly comprising a plurality of circumferentially spaced armature members for operating associated wire members and a plurality of circumferentially spaced inner and outer pole devices separated by rectangular slots. A coil is mounted on a bobbin member associated with each inner pole. A portion of each bobbin member is mounted in one of the slots and has wire connecting pin terminals extending through a flange portion of a wire housing for connection to a printed circuit board.

23 Claims, 7 Drawing Sheets

FIG. 18
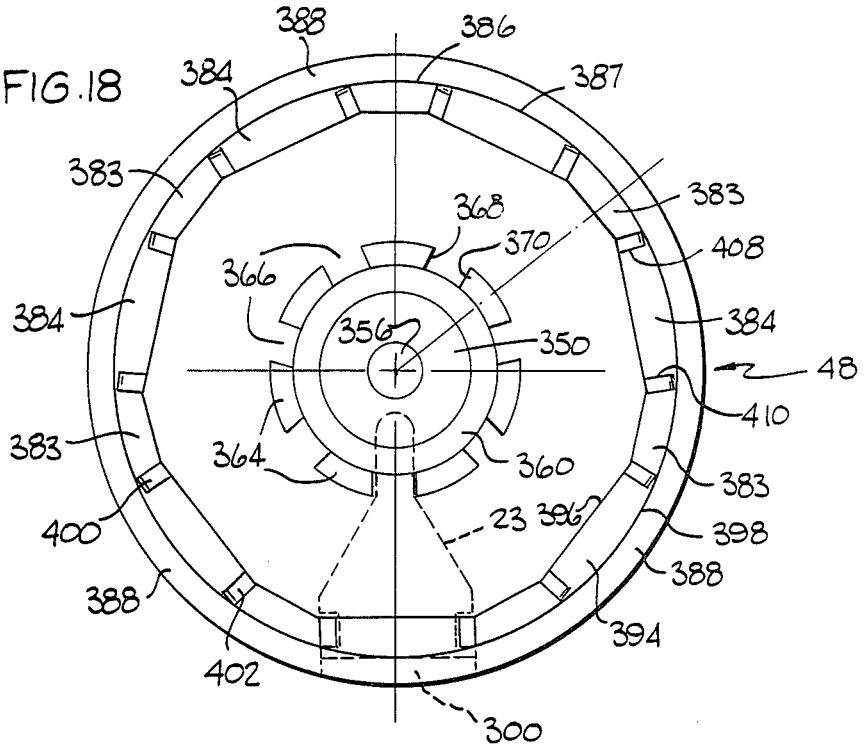
FIG. 19
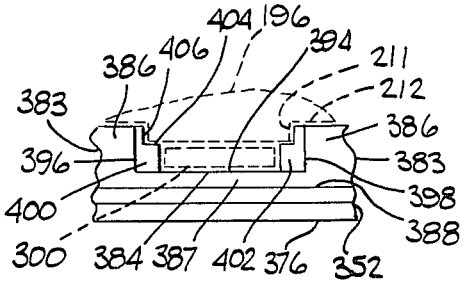
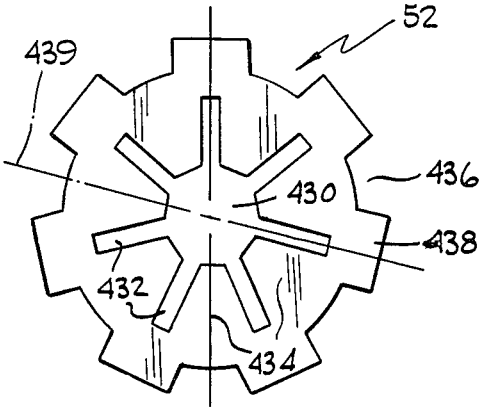
FIG. 20
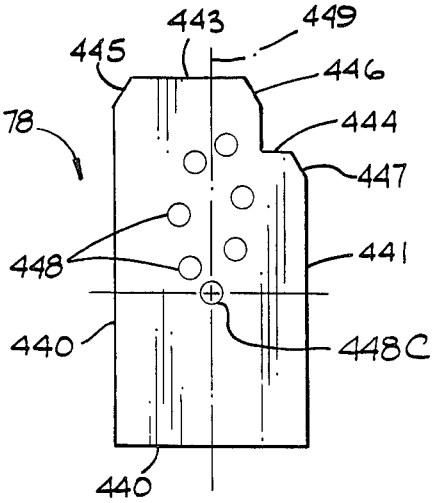
FIG. 21

DOT MATRIX PRINT HEAD ASSEMBLY

BACKGROUND AND SUMMARY OF THE INVENTION

This invention relates to a dot matrix print head assembly of the general types disclosed in my prior U.S. Pat. No. 4,478,528, the disclosure of which is specifically incorporated herein by reference, and my other prior U.S. Pat. Nos. 3,929,214; 3,994,381; 4,051,941; 4,185,929; 4,230,038; 4,230,412; 4,185,929 and 4,640,633.

At the present time, there is a need for a low cost, compact, small-size, print head assembly which is capable of high speed, high performance and reliable operation. In addition, in some applications, it is desirable to utilize more than one print head assembly with a single printer mechanism. It is also desirable to provide a print head assembly which can be easily installed in and connected to various types of printer mechanisms.

The present invention provides a low cost, compact, print head assembly which has an overall length of only about 1.5 inches and a maximum diameter of less than 1 inch. The invention also provides a print head assembly containing a minimum number of relatively low cost parts which are relatively easily assembled while providing high speed, high performance reliable operation. The present invention also provides a print head assembly which can be easily mounted on a printer mechanism by plug-in procedures with a minimum of assembly and mounting steps.

In general, the present invention comprises a new and improved overall construction and arrangement of print head parts. The invention further comprises a new and improved design and construction of a pole means and associated coil-bobbin means and associated plug-in type connector means which are constructed and arranged to minimize the size of the print head and enable plug-in mounting on and electrical connection to control circuitry of a printer mechanism. The invention further comprises a new and improved construction and design of an armature retainer cover means which enables accurate mounting and operation of the armatures in association with the magnetic pole means and the print wire members.

BRIEF DESCRIPTION OF DRAWINGS

Illustrative and presently preferred embodiments of the invention are shown in the accompanying drawings in which:

FIG. 18 is an armature end view of the cover member of FIG. 17;

FIG. 19 is a partial side view of the cover member showing an armature retainer slot means;

FIG. 20 is an end view of an armature spacer member of the print head assembly of FIG. 1; and FIG. 21 is an end view of the central wire guide member of the print head assembly of FIG. 1.

DETAILED DESCRIPTION

Figure 1:
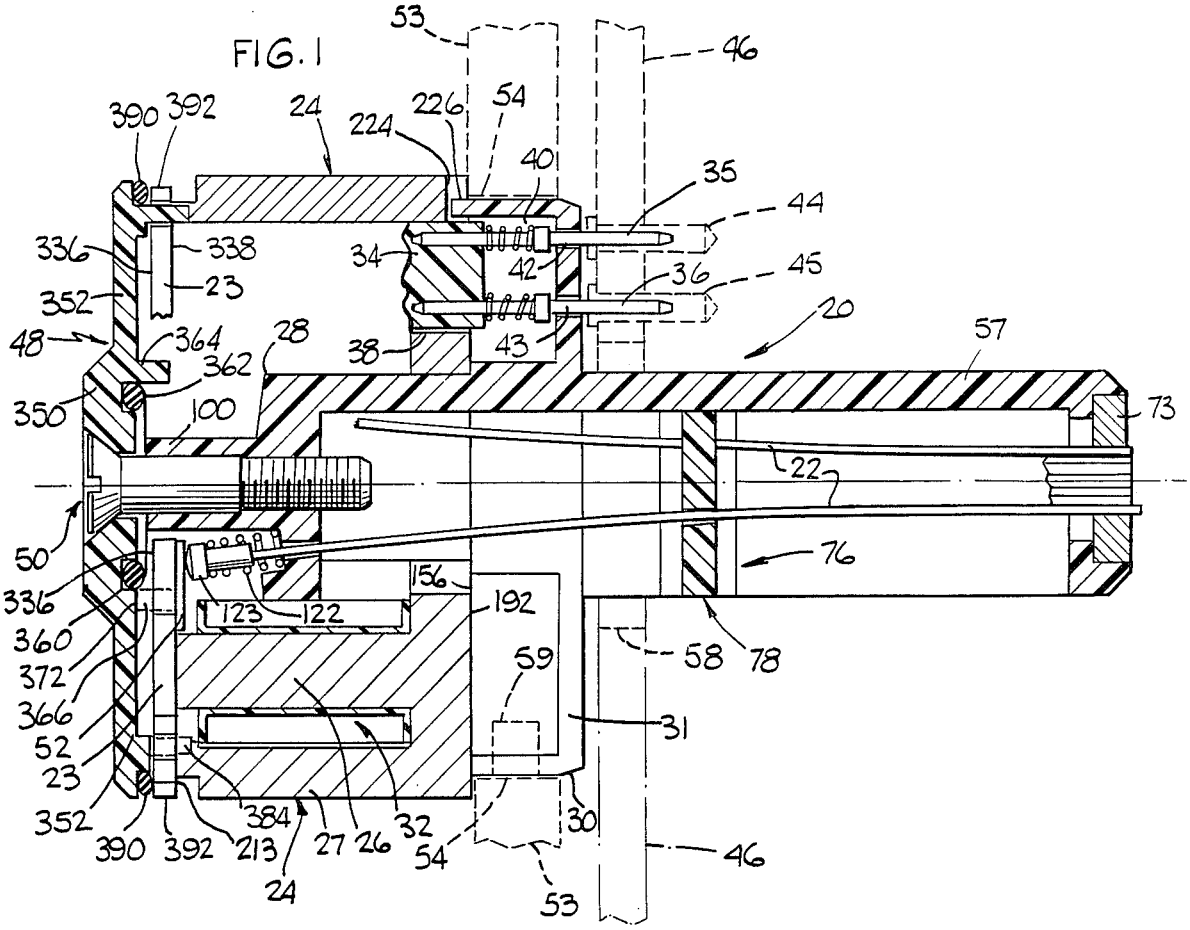
FIG. 1 is a longitudinal cross-sectional view of a dot matrix print head assembly of the present invention in association with a portion of a printer mechanism and a printed circuit board.
Figure 2:
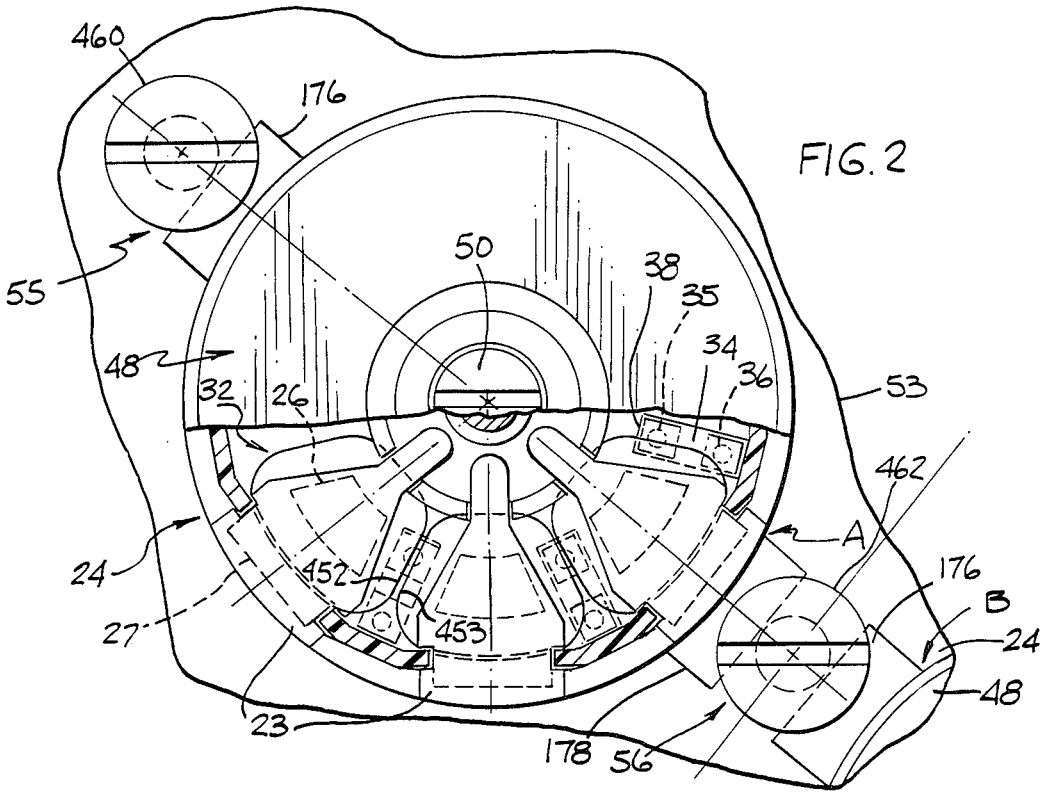
FIG. 2 is an end view, partly in section, of the drive end portion of the print head assembly of FIG. 1 in association with a second print head assembly.
Figure 3:
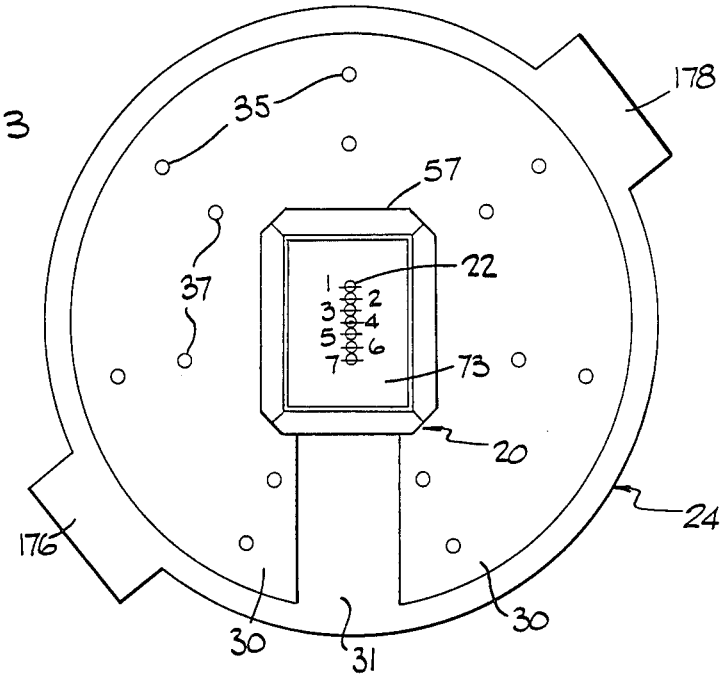
FIG. 3 is an end view of the print end portion of the print head assembly of FIG. 1.
Figure 4:
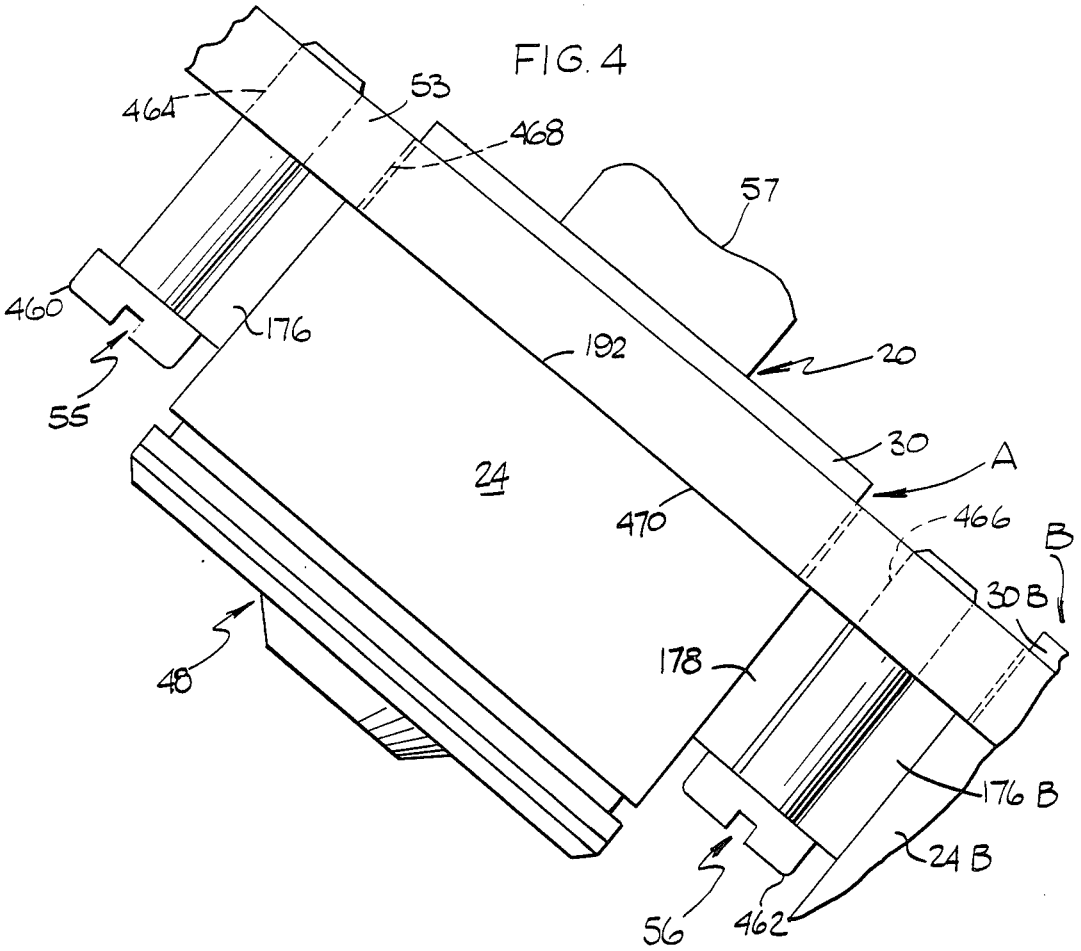
FIG. 4 is a side elevational view of the drive end portion of the print head assembly of FIG. 1 in association with a second print head assembly.

In general, as shown in FIGS. 1–4, the print head assembly of the present invention comprises a support housing means 20 made of one piece of molded plastic material for supporting a plurality of elongated print wire members 22 for selective axial movement between a retracted non-print position and an extended print position by selective actuation of a plurality of circumferentially spaced armature members 23. An annular magnetic pole means 24, for providing a plurality of circumferentially spaced pairs of inner and outer magnetic pole portions 26, 27 is mounted circumjacent a drive end portion 28 of housing means 20 in axially abutting engagement with an intermediate annular flange portion 30 of housing means 20 which has a radial locating slot 31. A plurality of circumferentially spaced electrical coil means 32 are mounted on pole portions 26 for selectively creating a magnetic field for actuation of the armature members. Each coil means 32 has an associated coil wire connecting means 34, including pin means 35, 36, extending axially through circumferentially spaced openings 38 in pole means 24, circumferentially spaced cavities 40 in housing flange portion 30, and circumferentially spaced pin guide hole means 42, 43 in housing flange portion 30 for plug-in connection to connector plug means 44, 45 of a printed circuit board means 46 connected to an electrical power source (not shown) for selectively energizing and de-energizing the associated coil means 32. An annular retainer cover means 48 made of one-piece of molded plastic material is mounted on housing drive end portion 28 by adjustable threaded fastener means 50 for locating and retaining armature members 23 in proper operational position relative to pole portions 26, 27 and print wire members 22, and for holding pole means 24 on housing means 20. An annular armature spacer means 52 may be optionally mounted between print wire members 22 and armature members 23 for reducing wear and noise. The length and diameter of the assembly are approximately only 1½ inches and 0.806 inch. In use on a printer mechanism, the print head assembly is mounted on a printer mechanism support plate means 53 having an annular opening 54 by fastening means 55, 56. Support housing flange portion 30 is located in support plate opening 54 and pole means 24 abuts the support plate means circumjacent the support plate opening 54. Printed circuit board means 46 is mounted in parallel juxtaposition to support plate means 53 and support housing flange portion 30 with the elongated wire guide portion 57 of support housing means 20 extending through an opening 58 in the printed circuit board means 46. A key means 59 on support plate means 53 is received in locating slot 31 on support housing flange portion 30. As shown in FIGS. 2 & 4, a plurality of the small-size print head assemblies of the same construction A and B (only partially shown) may be mounted in juxtaposition to one another on the same printer mounting plate means 53 with use of common fastening means 56.

Support housing means 20 is made of one piece of molded plastic material, such as LNP RFL 4036 Nylon 6-6 with 30% glass fibers and 15% PTFE, and has a length of approximately 1.25 inches and a maximum diameter of approximately 0.74 inch. As shown in FIGS. 5–10, the wire guide portion 57 of support housing means 20 has an U-shape cross-sectional configuration, defined by a pair of laterally spaced side wall portions 62, 64, FIG. 10, and a transverse upper connecting wall portion 66 which provide an elongated rectangular slot 67 and terminating in a print end wall portion 68, FIGS. 5 & 6, having a rectangular wire passage slot 70 and a rectangular bearing plate mounting slot 72 for mounting a bearing plate means 73, FIG. 1, which supports the print end portions of the wire members in a linear array as shown in FIG. 3. A pair of oppositely spaced intermediate wire guide plate mounting rib and slot means 74, 76, FIG. 6, are provided on side wall portions 62, 64 for mounting of an intermediate wire guide plate means 78, FIG. 1. Mounting means 74, 76 comprise rib portions 80, 81 and 82, 83 which define slots 84, 85, FIG. 6. As shown in FIG. 10, one slot 84 extends to the bottom surface 86 of upper wall portion 66 while the other slot 85 is of shorter length and extends to a downwardly spaced end surface 87 so that the intermediate wire guide means 78 must be mounted in the correct assembled position as hereinafter discussed.

Figure 5:
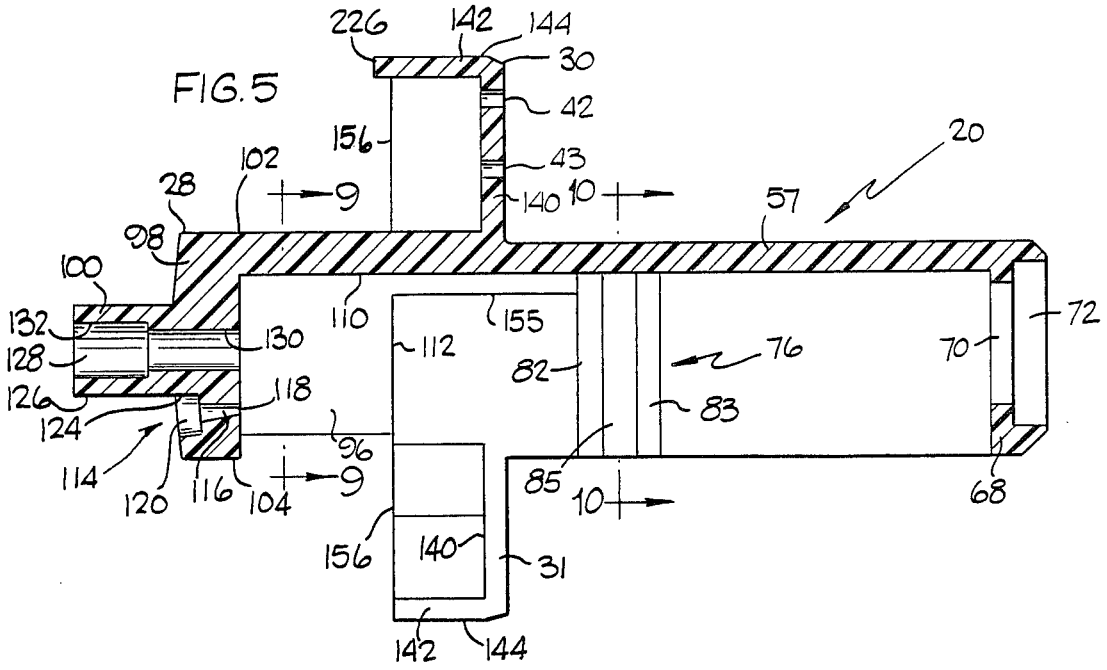
FIG. 5 is a longitudinal cross-sectional view of the wire housing member of the print head assembly of FIG. 1.
Figure 6:
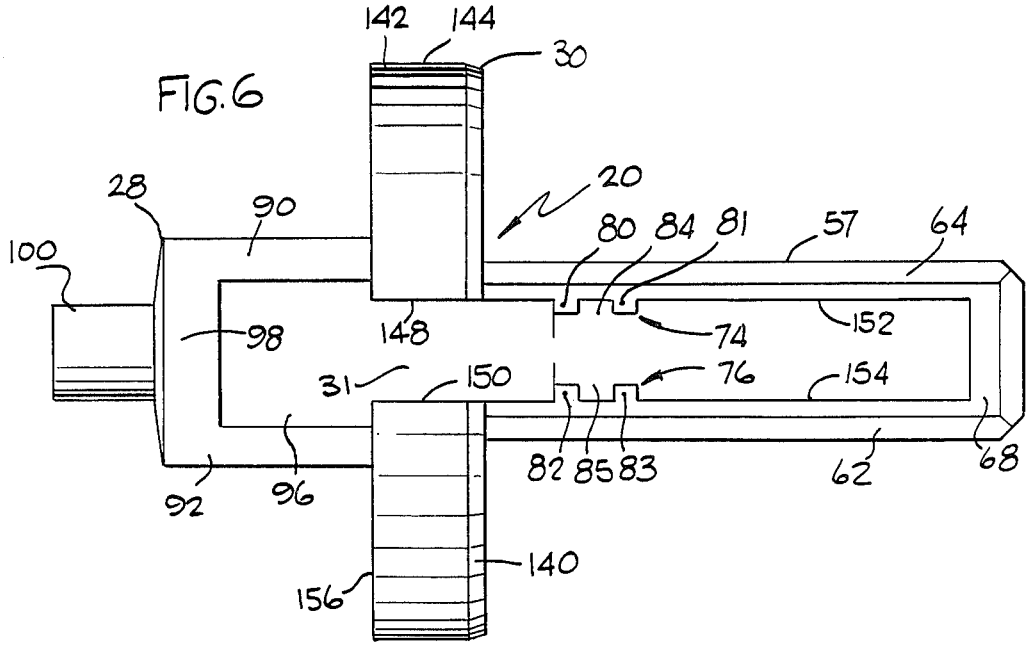
FIG. 6 is a bottom view of the wire housing member of FIG. 5.
Figure 9:
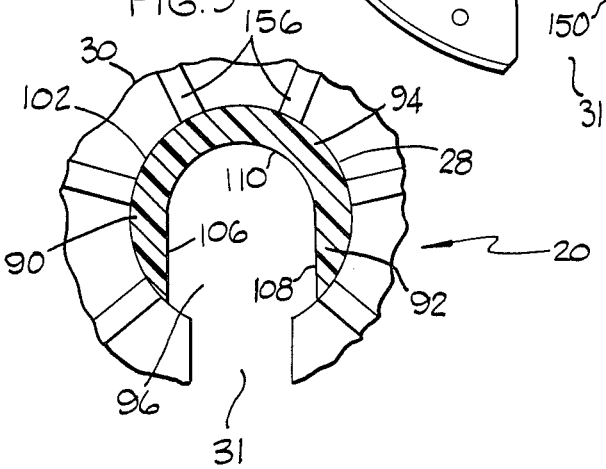
FIG. 9 is a transverse cross-sectional view of the wire housing member taken along line 9—9 in FIG. 5.
Figure 10:
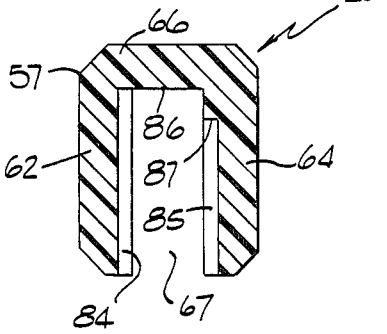
FIG. 10 is a transverse cross-sectional view of the wire housing member taken along line 10—10 in FIG. 5.

Drive end housing portion 28 has a generally cylindrical cross-sectional configuration defined by a pair of laterally spaced side wall portions 90, 92, FIG. 9, and an arcuate transverse upper connecting wall portion 94 which provide an elongated slot 96 terminating in an annular end wall portion 98, FIGS. 5 & 6, having an annular hub portion 100. Wall portions 90, 92, 94, 98 have concentric cylindrical outer peripheral surfaces 102, 104. Slot 96 has opposed spaced parallel side surfaces 106, 108, connected by an upper arcuate surface 110, FIG. 9. As shown in FIG. 5, arcuate surface 110 extends axially to rib portions 80, 82 and flat parallel side surfaces 106, 108 extend to side surfaces 112.

A plurality of circumferential spaced wire guide passage and bearing means 114, FIG. 5, extend through end wall portion 98. Each wire guide and bearing passage means 114 comprises an axially inclined conical passage portion 116 terminating at one end in a reduced diameter bearing hole portion 118 and having enlarged counterbore 120 at the opposite end for receiving a print wire return and positioning compression spring means 122, FIG. 1, associated with conventional wire end cap means 123. The radially innermost surface portion 124, FIG. 8, of each counterbore is formed by a portion of the cylindrical peripheral surface 126 of hub portion 100. A central fastener passage means 128 extends through end wall portion 98 and hub portion 100 to provide a threadable portion 130 and an enlarged counterbore portion 132 for receiving self-threading fastening means 50 as shown in FIG. 1.

Flange means 30, FIGS. 5–8, comprises a radially outwardly extending generally annular side wall portion 140 which terminates in a generally cylindrical axially extending rim portion 142 having a generally cylindrical outer peripheral surface 144. Side wall portion 140 and rim portion 142 are interrupted by radially extending slot 31 defined by spaced parallel side surfaces 148, 150 which extend axially from side surface 112 to rib portions 80, 82 and are coplanar with inner side surfaces 152, 154, FIG. 6, of side wall portions 62, 64 and intersect curved upper surface 110 at 155, FIG. 5. A plurality of radially outwardly extending support rib portions 156, FIGS. 7 & 9, extend between cylindrical surface 102 and rim portion 142 to define a plurality of generally trapezoidal pockets 158 therebetween. Pin passages 42, 43 are located on radial lines 160 centrally located between rib portions 156.

Figure 11:
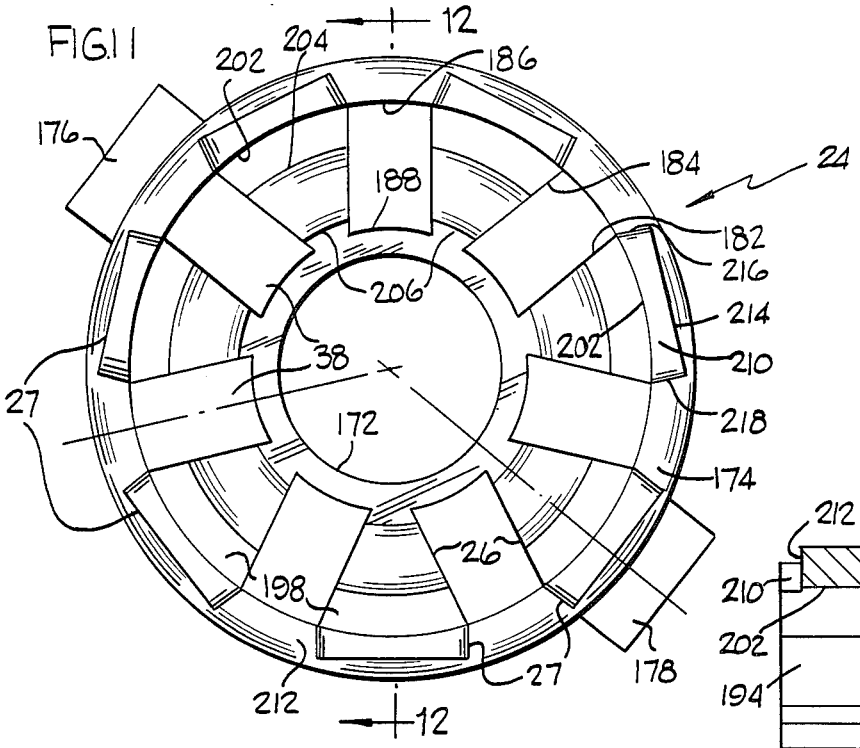
FIG. 11 is an end view of the armature end portion of the pole member of the print head assembly of FIG. 1.
Figure 12:
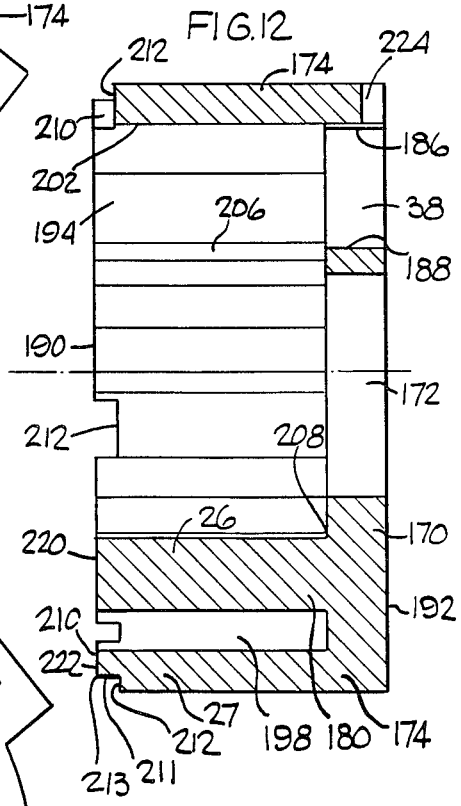
FIG. 12 is a longitudinal cross-sectional view of the pole member taken along line 12—12 in FIG. 11.
Figure 13:
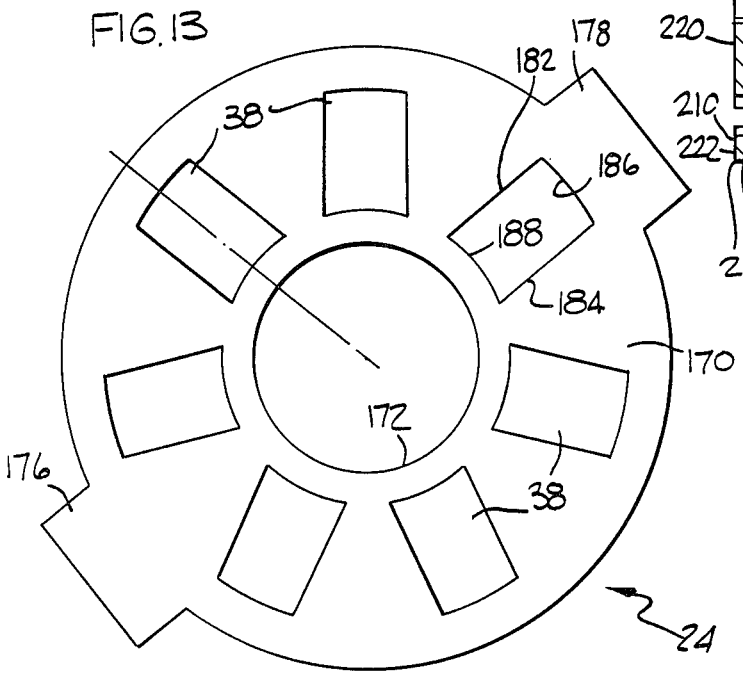
FIG. 13 is an end view of the connector end portion of the pole member.

Pole means 24 is made of one piece of sintered powder magnetic material, such as 3% silicon iron with a carbon content of approximately 0.05% or less, a size of approximately 0.390 inch length by 0.812 inch diameter. As shown in FIGS. 11–13, pole means 24 comprises a radially outwardly extending annular side wall portion 170, having a central annular passage 172, and a generally annular axially extending outer rim portion 174, which includes a pair of oppositely spaced radially outwardly extending mounting flange portions 176, 178, and an annular axially extending segmented inner rim portion 180. The circumferentially spaced axially extending connector slots 38 have circumferentially spaced flat parallel side surfaces 182, 184 and arcuate end surfaces 186, 188, which extend through side wall portion 170 between axially spaced radially extending side surfaces 190, 192. Slots 38 separate the inner rim portion 180 into a plurality of circumferentially spaced generally trapezoidal individual inner pole portions 26. Each of the associated inner and outer pole portions 26, 27 are separated by concentric arcuate slots 198 which provide axially extending radially spaced arcuate side pole surfaces 202, 204. The innermost pole portions 26 are defined by axially extending arcuate radially innermost side surfaces 206, provided by a counterbore 208, side surfaces 182, 184 of slots 180 and arcuate side surface 204 of slots 198. Outer pole end portions 210 have a generally rectangular peripheral configuration defined by an axially offset outer peripheral rim side surface 212, a straight flat outer side surface 214, circumferentially spaced parallel side surfaces 216, 218 and curved, inner peripheral slot side surface 202. The end surfaces 220, 222 of the inner and outer pole portions are precision ground flat and coplanar. A locating notch 224 is provided in end wall portion 170 to receive a locating lug 226, FIGS. 5 & 7, on housing rim portion 142.

Figure 14:
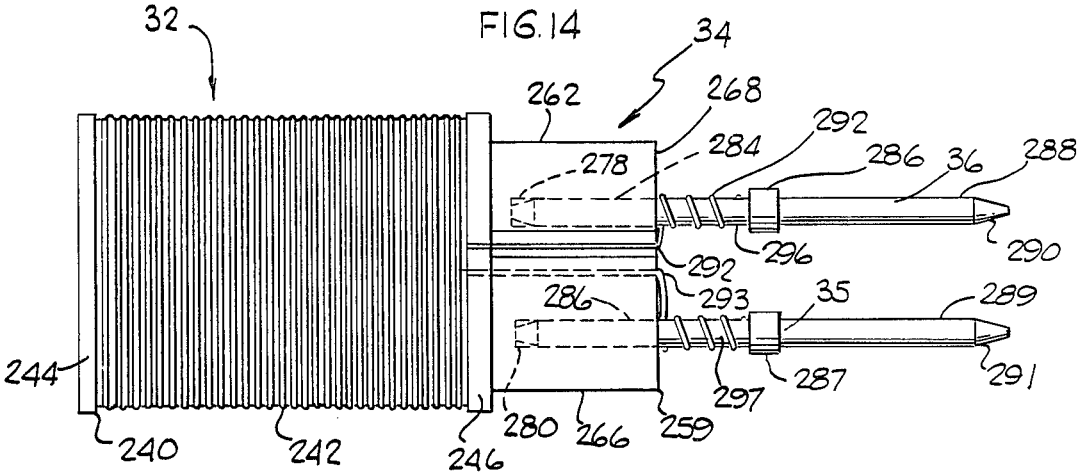
FIG. 14 is a side elevational view of the coil and electrical connector means of the print head assembly of FIG. 1.
Figure 15:
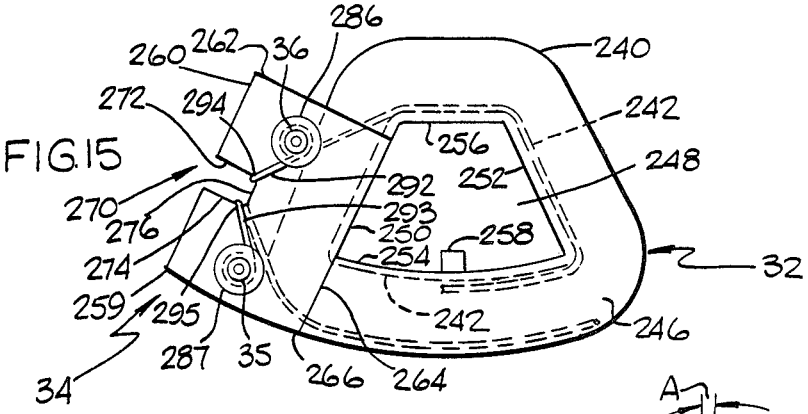
FIG. 15 is a connector end view of the coil and electrical connector means of FIG. 14.

Each of the coil means 32, FIGS. 14 & 15, comprises a bobbin means 240 for supporting a single-film coated electrical copper magnet wire coil 242 of 376 turns providing a resistance of 9.5+0.5 ohms at 75° F. with an associated connecting means 34 for supporting connecting pin members 35, 36. In the preferred embodiment, the bobbin means 240 and connecting means 34 are made of one piece of molded plastic material such as an LNP RF 1004 Nylon 6-6 with 20% glass fibers. The bobbin means 240 comprises a central core portion 242 extending between axially spaced end flange portions 244, 246. Core portion 243 has a central passage 248 having a generally trapezoidal cross-sectional configuration generally corresponding to the cross-sectional configuration of inner pole portions 26 and being defined by inclined straight flat side wall portions 250, 252, an arcuate flat outer side wall portion 254, and a straight flat inner sidewall portion 256. A locating rib 258 extends inwardly from surface 254. Connecting means 34 comprises a connecting block member 259 having a generally rectangular cross-sectional configuration generally corresponding to housing slots 180 and defined by flat side surfaces 260, 262, 264, a curved side surface 266 and a flat end surface 26B. An elongated axially extending wire slot means 270 is defined by side surfaces 272, 274 and an end surface 276. Pin holes 278 and 280 extend axially from end surface 268. Pin means 35, 36 have one end portion 284, 285 axially mounted in the pin holes, a central annular flange portion 286, 287, and elongated connecting end portions 288, 289 with tapered end portions 290, 291. Wire end portions 292, 293 extend axially along and are located at the intersections 294, 295 of side surfaces 272, 274 and end surface 276 and extend therealong and are wound around and soldered to intermediate portions 296, 297 of pin means 35, 36.

Figure 16:
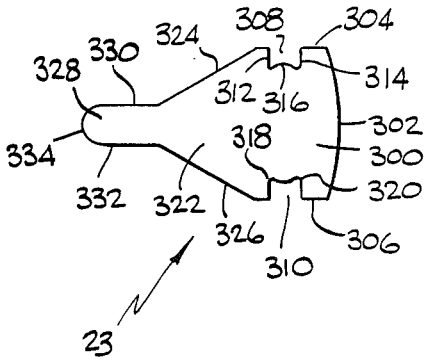
FIG. 16 is a side view of an armature member of the print head assembly of FIG. 1.

Each of the armature means 23 is made of one piece of 0.280×0.200×0.032 inch steel material such as $2\frac{1}{2}$–3 percent silicon magnet steel material having an 0.05% maximum carbon content which is nickel plated. As shown in FIG. 16, each armature comprises an outer end portion 300 with a curved end surface 302, spaced parallel flat side edge surfaces 304, 306 and opposite slot means 308, 310. Each slot means 308, 310 has spaced parallel flat side surfaces 312, 314 and a curved end surface 316 connected to side surfaces 312, 314 by reversely curved surfaces 318, 320. Each armature further comprises a generally trapezoidal shape intermediate portion 322 defined by inclined flat side surfaces 324, 326 and a narrow width elongated nose portion 328 defined by straight parallel spaced side surfaces 330, 332 and a rounded curved end surface 334. Flat parallel side surfaces 336, 338, FIG. 1, are nickel plated and precision finished to provide an 0.0320±0.0003 inch armature thickness therebetween.

Figure 17:
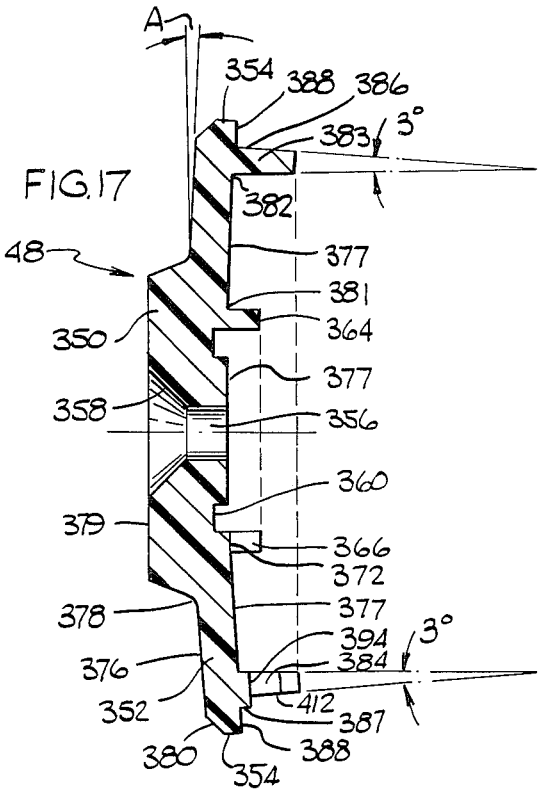
FIG. 17 is a cross-sectional view of the armature retainer cover member of the print head assembly of FIG. 1.

Armature retainer cover means 48, FIGS. 17–19, is made of one piece of molded plastic material, such as G.E. Ultem 1000 Polyetherimide material, with an outside diameter of approximately 0.804 inch and a maximum width of approximately 0.141 inch. A rigid central hub portion 350 supports a flexible annular flange portion 352 terminating in an annular rim portion 354. Hub portion 350 has a central bore 356 and a conical counterbore 358 for receiving fastening means 50. An annular slot 360 receives a resilient O-ring member 362, FIG. 1. A plurality of circumferentially spaced axially extending concentric rib means 364 and slot means 366 are provided circumjacent O-ring member 362 for guidably supporting the nose portions of the armatures. Each slot means 366 has a pair of spaced parallel flat side surfaces 368, 370 and a flat bottom surface 372 which is coplanar with hub inner side surfaces 374, FIG. 17. O-ring member 362 has a cross-sectional diameter such as to extend axially inwardly beyond slot bottom surface 372 so that circumferentially spaced portions are engageable with outer side surfaces 336 of each armature in the retracted non-print position (not shown).

Flange portion 352 is axially inwardly inclined at an angle A of approximately 3°, as shown in FIG. 17, as manufactured in an unflexed pre-assembled condition for a purpose to be hereinafter described. Flange portion 352 comprises flat parallel outer and inner annular side surfaces 376, 377. Outer side surface 376 extends from a 3° intersection 378 with transverse side surface 379 of hub portion 350 to an inclined rim end surface 380. Inner side surface 377 extends radially outwardly at an inclined angle of 3° from an intersection 381 with the outer annular side wall surfaces of rib means 364 to an intersection 382 with outermost generally annular axially inwardly extending, circumferentially spaced rib means 383 which are separated by a plurality of circumferentially spaced armature slot means 384 for receiving radially outermost portions 300 of the armatures 23. Rib means 383 and slot means 384 have arcuate adjoining axially extending outer peripheral side surfaces 386, 387 which intersect a continuous annular outermost radially extending side surface 388 coplanar with flange side surface 377 to provide a seat means for a radially outermost O-ring member 390, FIG. 1, which abuts a radially outermost portion 392 of each armature. Each of the slot means 384 has a flat bottom wall surface 394 which intersects a flat straight-line side wall surface 396 and a radially outermost annular curved side wall surface 398 of larger radius than the annular curved rib side wall portions 386 between the slots 384. Each slot has a pair of oppositely spaced L-shape lug portions 400, 402, FIG. 19, which each provide an end surface 404 and a side surface 406 corresponding to surfaces 211, 212, FIG. 12, of outer pole portions 210 so as to enable axially slidable relative movement therebetween and abutting engagement between lug end surface 404 and pole side surface 212. Lug portions 400, 402 have a cross-sectional configuration corresponding to armature slots 308, 310, FIG. 18, with oppositely facing flat parallel side surfaces 408, 410 spaced so as to be slidably engageable with armature slot side surfaces 316. The radially outermost side surface 412, FIG. 17, of each lug portion is tapered at an angle of 3° during manufacture so that in the flexed, assembled position, the inclined surface 412 will become parallel with pole surface 211 as the cover flange is resiliently flexed to a radially extending position from the non-flexed position of 3° inclination. The outer side surfaces 386 of the rib means are similarly inclined at an angle of 3° during manufacture.

The armature spacer means 52 is made of one piece of Mylar-type NA Grade EB11 material of approximately 0.46 diameter×0.005 inch thickness. As shown in FIG. 20, armature spacer means 52 has a generally annular configuration with a central passage 430 for receiving the housing hub portion 100 and a plurality of circumferentially spaced radially extending slots 432 for providing separate flexible spacer portions 434. The outer periphery has a plurality of circumferentially spaced slots 436 and tab portions 438 having a configuration corresponding to the inner pole portions so as to be received therebetween.

Intermediate guide plate means 78, FIG. 20, comprises one piece of approximately 0.23×0.126×0.030 inch molded plastic material such as LNP RL 4540 Nylon 6-6 with 18% PTFE and 2% silicon. It has a peripheral configuration corresponding to housing slot and rib means 74, 76 and defined by spaced flat parallel side surfaces 440, 441, a bottom surface 442, a pair of offset upper surfaces 443, 444, and inclined connecting surfaces 445, 446, 447. A plurality of wire guide holes 448 are formed in a generally elliptical pattern with the bottommost hole 448c located on centerline 449 and the other six holes being located in laterally outwardly and upwardly staggered relationship to hole 448c and one another.

In assembly and operation, the pole means unit 24 is mounted on housing portion 28 by axial sliding movement until pole end surface 192 abuts housing side surface 156 and housing tang portion 226 is located in pole means slot 224. The wire members 22 are mounted in housing means 20 and extend through center guide means 78 and end bearing plate means 73. Coil means 32 are inserted simultaneously by axial sliding movement with the associated connector means 34 extending through associated connector means slots 38 and the associated pin means 35, 36 extending through housing pin holes 42, 43. Each bobbin means 240 is mounted on and supported by the associated inner pole 194 with a portion located in the associated slot 198 between the associated inner pole portion 26 and outer pole portion 27. As shown in FIG. 2, in the assembled position, adjacent bobbin flange side surfaces 452, 453 are in closely spaced radially extending parallel relationship to one another with adjacent side portions in overlapping relationship to connector means 34. Armature spacer means 52 is axially inwardly inserted with finger portions 438 located between adjacent inner pole portions and housing end portion 100 extending through center hole 430 so that each wire end button 123 is centrally located on a radial line 439, FIG. 26, in abutting engagement with each finger portion 434.

Armature members 23 are located in the associated armature retaining slot means in cover means 50 and located in radial alignment with the associated inner and outer pole portions 26, 27, as illustrated in FIG. 2. Fastening means 50 is threadably connected to housing means end portion 100 and holds the abutment rib means 383 on the cover rim portion 354 in abutting engagement with the outer pole surface portions 211, 212. Armature members 23 are confined in the cover armature slot means 366, 384 for pivotal movement between the retracted non-print position and the extended print position. In the non-print position (not shown), compression spring means 122 moves the radially inwardmost portion of each associated armature into engagement with innermost O-ring member 362 by pivotal movement about the outermost straight edge portion 213 of the associated outer pole portion 27. Outermost O-ring member 390 engages the radially outermost portion of armature side surface 336 radially outwardly adjacent pivotal pole edge means 213. Each armature is selectively pivotally movable from the non-print position to the print position, shown in FIG. 1 by selective energization of the associated coil means which creates a magnetic field causing the radially inwardmost portion of the associated armature to be pivotally displaced toward the print position shown in FIG. 1 and drive the associated print wire to the print position. The radially outermost portion of the armature moves in the opposite direction against the outermost O-ring member 390 while the radially inwardmost armature portion becomes disengaged from the innermost O-ring member 362. The amount of pivotal movement and the armature gap can be selectively adjustably controlled by turning threaded fastening means 50. During assembly, the cover flange portion is resiliently deflected from the 3° angle of inclination shown in FIG. 17 by the force of engagement of the rib abutment means with the outer pole portions and axial displacement of the rigid cover hub means 350 as the fastening means 50 is threaded into the housing end portion 100. Thus, in the assembled position of FIG. 1, cover flange portion 352 extends transversely at substantially a right angle to the central axis of the hub portion 350.

Figure 7:
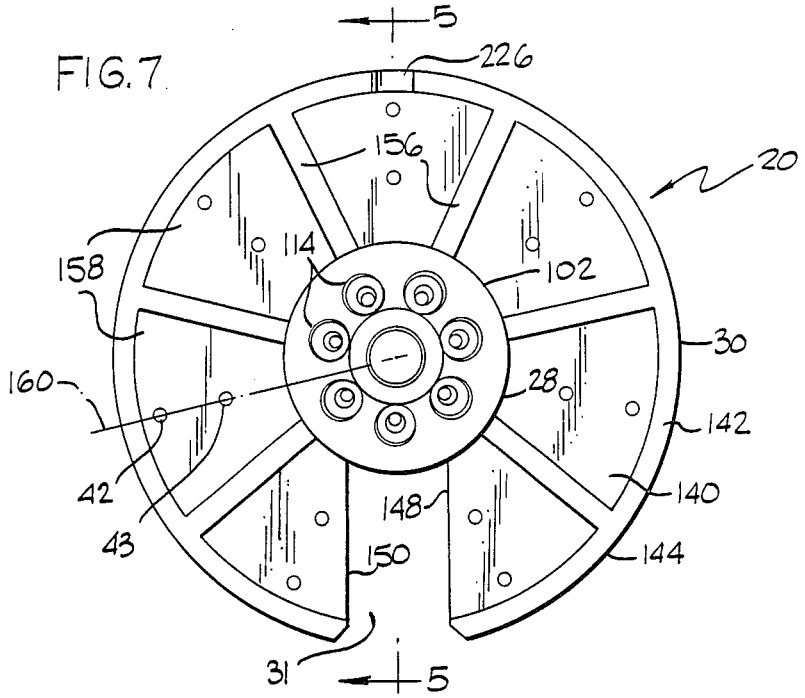
FIG. 7 is an end view of the drive end portion of the wire housing member of FIG. 5.
Figure 8:
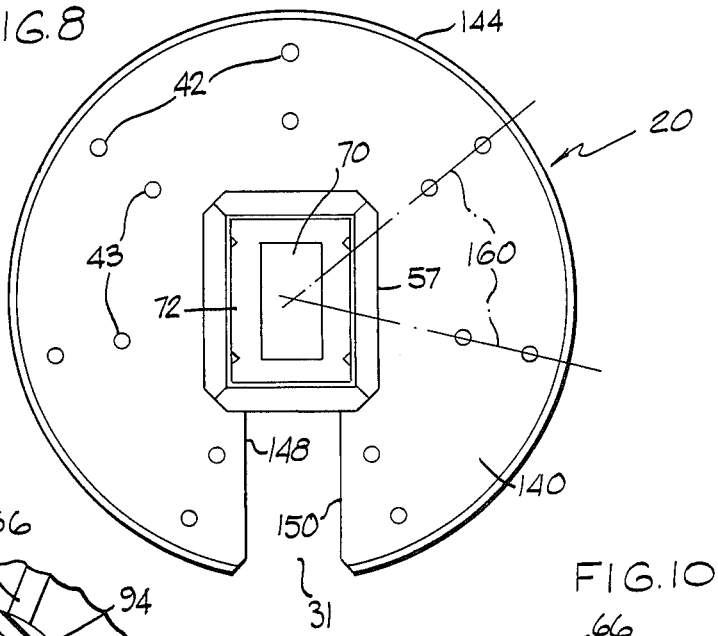
FIG. 8 is an end view of the print end portion of the wire housing member of FIG. 5.

In use, the print head assembly is mounted on a support member 53 of conventional dot matrix printer mechanism by suitable threaded fastening means 460, 462, FIGS. 2 7 4, received in threaded openings 464, 466. Fastening means 460, 462 engage the mounting flange means 176, 178 on the pole means 24 with housing rim portion 30 located in an annular opening 468 in the support member and pole means side surface 142a-butting support member side surface 470. A plurality of print head assemblies may be mounted in closely spaced relationship on the support member as illustrated in FIGS. 2 & 4 with one of the fastening means 462 engaging a mounting flange means 176B of an adjacent print head assembly B. Printed circuit board means 46 has a central opening 58 to receive wire housing portion 57 and is suitably mounted in juxtaposition to the support member 53 with a plurality of circumferentially spaced pin receptacle means 44, 45 located in alignment with connecting pin means 35, 36. Thus, the print head assembly and printed circuit board means are connected by a simple plug-in type procedure.

The inventive concepts may be variously otherwise embodied and employed. It is intended that the appended claims be construed to include alternative embodiments except insofar as limited by the prior art.

What is claimed is:

1. A dot matrix wire print head assembly for mounting on a printer mechanism and connection to electrical control circuitry associated with the printer mechanism and comprising:

a plurality of elongated wire print members having drive end portions mounted in a circumferentially spaced array and print end portions mounted in a linear array for selective axial movement between a retracted non-print position and an extended print position;

an elongated wire housing means made of one piece of plastic material for supporting said wire print members and having a print end portion and a drive end portion and a radially outwardly extending intermediate flange portion;

each of said wire print members being operably associated with one of a plurality of circumferentailly spaced radially extending armature members mounted adjacent said drive end portions for selective pivotal movement between a non-print position and a print position;

electro-magnetic pole means mounted on said housing means adjacent said armature members for providing a plurality of pairs of equally circumferentially spaced equal-size and shape inner pole portions and associated outer pole portions with one of each of said pairs of inner pole portions and said associated outer pole portions being operably associated with each of said armature members for selectively causing pivotal movement of each of the associated armature members between said non-print position and said print position;

said pole means having a radially extending end wall portion located axially adjacent said intermediate flange portion and a central housing passage means in said end wall portion for receiving and supporting an intermediate portion of said wire housing means and an axially extending generally cylindrical radially outermost annular side wall portion extending from said end wall portion toward said armature members;

each of said outer pole portions being located on said radially outermost annular side wall portion of said pole means axially adjacent and having an outer pole end surface facing an associated one of said armature members;

a radially outermost annular slot means in said pole means circumjacent said radially outermost annular side wall portion for equally radially spacing and separating each of said inner pole portions from the associated one of said outer pole portions and extending axially from said end wall portion to said outer pole end surface of each of said outer pole portions;

each of said inner pole portions being integrally connected to said radially extending end wall portion of said pole means circumjacent said central passage means and extending axially toward the associated one of said armature members and having an inner pole end surface located axially adjacent and facing an associated one of said armature members;

each of said inner pole portions having a segmental cross-sectional configuration defined by a pair of circumferentially spaced radially extending flat side surface portions, a radially outermost side surface portion, and a radially innermost side surface portion;

circumferentially adjacent flat side surface portions of circumferentially adjacent ones of said inner pole portions being equal circumferentially spaced and parallel to one another and extending axially from said radially extending end wall portion of said pole means to said end surface of each of said inner pole portions;

a radially innermost annular slot means in said pole means between said inner pole portions and said central pasage means and extending axially from said end wall portion to said inner pole end surface of each of said inner pole portions for receiving said drive end portion of said housing means;

a plurality of equal-size and shape and equally circumferentially spaced radially extending slot means of generally rectangular cross-sectional configuration located between said inner pole portions for equally circumferentially spacing said inner pole portions from one another;

each radially extending slot means being defined by said circumferentially adjacent flat side surface portions of circumferentially adjacent ones of said inner pole portions and extending axially from said end wall portion of said pole means to said inner pole end surface of said inner pole portions and extending radially between said intersecting said radially outermost annular slot means and said radially innermost annular slot means;

each of said inner pole portions and associated one of said outer pole portions being operably associated with one of a plurality of equally circumferentially spaced equal-size and shape electrically energizable coil means for selectively creating a magnetic field for operation of the associated armature member;

each of said cool means having a bobbin member with an axially extending core portion and axially spaced end flange portions, one of said flange portions being located in juxtaposition to said end wall portion of said pole means and the other of said flange portions being located in juxtaposition to said end surface of said associated one of said inner pole portions;

said core portion of each bobbin member having a central axially extending pole passageway of segmental cross-sectional configuration corresponding to said segmental cross-sectional configuration of the associated one of said inner pole portions and said associated one of said inner pole portions being located in said central axially extending pole passageway;

a plurality of equal-size and shape equally circumferentially spaced radially extending connector slots means in and extending axially through said end wall portion of said pole means and being aligned with said radially extending slot means between said inner pole portions for connecting said coil means to the electrical control circuitry;

each bobbin member having a connector block means for mounting in said connector slot means and being mounted on one side of and extending axially toward said print end portion of said wire housing means along said bobbin member in coaxial relationship with said radially extending slot means and said connector slot means and having a terminal portion extending axially beyond said one flange portion of said bobbin member through said connector slot means in said end wall portion of said pole means;

each of said coil means having a wire coil with coil wire end portions operably associated with plug-in terminal means mounted on said terminal portion of said connector block means and extending axially toward said print end portion of said wire housing means through and beyond said intermediate radially outwardly extending flange portion of said wire housing means for plug-in connection to a printed circuit board associated with the electrical control circuitry of the printer mechanism; and retainer cover means mounted on said drive end portion of said housing means opposite said armature members and said electro-magnetic pole means for holding said armature members in operative association with each of said pairs of inner pole portions and associated outer pole portions.

2. The invention as defined in claim 1 and wherein said plug-in terminal means further comprising:

a pair of laterally spaced pin means fixedly mounted in said connector block means for plug-in electrical connection to connector passages in the printed circuit board associated with the printer mechanism.

3. The invention as defined in claim 1 or 3 and wherein said pole means further comprising:

mounting means on said pole means for mounting the print head assembly on the printer mechanism.

4. The invention as defined in claim 3 and wherein said mounting means comprises:

flange means extending radially outwardly from the outer periphery of said annular end wall portion.

5. The invention as defined in claim 1 and wherein:

said pole means being made of one piece of metallic material and having a solid annular outer peripheral rim portion on said annular side wall portion which provides said outer pole portions and having an inner annular peripheral side wall portion which is segmented by said circumferentially spaced radially extending slot means and provides said inner pole portions.

6. The invention as defined in claim 5 and wherein:

said radially outermost annular slot means is concentrically located between said annular outer peripheral rim portion and said inner annular peripheral side wall portion for providing uniform radial spacing therebetween and for receiving a radially outermost portion of each of said coil means.

7. The invention as defined in claim 6 and wherein:

each of said coil means having a radially outermost portion mounted in said radially outermost annular slot means between said outer pole portion and said inner pole portion, and a pair of radially extending side portions mounted in circumferentially adjacent ones of said radially extending slot means, and a radially innermost portion mounted circumjacent said central passageway in said annular end wall portion.

8. The invention as defined in claim 7 and wherein:

each of said inner pole portions comprising a flat segmental shape outer end armature abutment surface and an arcuate radially innermost peripheral surface and an arcuate radially outermost peripheral surface and a pair of circumferentially spaced flat non-parallel radially inwardly inclined peripheral side surfaces extending generally radially between said radially outermost peripheral side surface and said radially innermost peripheral side surface.

9. The invention as defined in claim 8 and wherein:

each of said outer pole portions comprising a flat outer pole end armature abutment surface portion, an arcuate radially innermost peripheral side surface located radially outwardly of said arcuated radially outermost peripheral surface of the associated one of said inner pole portions and being axially co-extensive therewith, a radially outermost flat chorded peripheral side surface which is radially inwardly spaced from an annular outer end surface on said radially outermost side wall portion of said pole means and extends axially outwardly toward and intersects said outer pole end armature abutment surface portion to provide a straight line pivot edge means for pivotally supporting the associated armature member; and a pair of circumferentially spaced flat parallel side surfaces which extend axially outwardly from said outer annular peripheral end surface a relatively short distance and define a circumferentially extending outer peripheral slot therebetween.

10. The invention as defined in claim 9 and wherein:

each of said armature members comprising a radially outermost portion having an arcuate outermost peripheral surface concentric with said annular outer peripheral surface of said pole means and spaced parallel straight side surfaces which are generally coplanar with said spaced parallel flat side surfaces of said outer pole portion, and an intermediate generally trapezoidal portion having inclined side surfaces which are parallel and generally coplanar with said generally radially extending side surfaces of said inner pole portion, and a reduced width radially innermost nose portion having flat spaced parallel side surfaces extending radially inwardly beyond said drive end portions of said wire members.

11. The invention as defined in claims 1 or 7 or 8 or 9 or 10 and further comprising:

mounting flange means on intermediate radially extending flange portion of said housing means for engaging and supporting said end wall portion of said electro-magnetic pole means; and a plurality of circumferentially spaced axially extending connector passage means in said intermediate radially extending flange portion for receiving and enabling passage to and connection with said printed circuit board of said plug-in terminal means of said connector block means of each of said coil means.

12. The invention as defined in claim 11, and wherein said intermediate radially outwardly extending flange portion further comprising:

a plurality of circumferentially spaced pocket means for receiving a portion of said connector block means and each of said connector passage means being located in one of said pocket means.

13. The invention as defined in claim 12 and said intermediate radially extending flange portion on said housing means further comprising:

a plurality of circumferentially spaced radially extending rib portions and an annular rim portion providing said pocket means and abutment surface means for abutting engagement with and axial location of said pole means relative to said housing means.

14. The invention as defined in claims 1 or 7 or 8 and wherein:

said connector block means and said connector slot means and said radially extending slot means having a similar polygonal cross-sectional configuration.

15. The invention as defined in claim 14, and wherein:

said cross-sectional configuration is rectangular.

16. The invention as defined in claim 15 and wherein said connector block means further comprising:

an elongated axially extending peripheral wire slot means extending from said wire coil means to said plug-in terminal means for receiving and retaining wire end portions of said wire coil means which are connected to said plug-in terminal means.

17. The invention as defined in claim 16 and wherein said peripheral wire slot means having a polygonal cross-sectional configuration and comprising:

a pair of laterally spaced side surface portions which intersect an end surface portion defining a pair of laterally spaced corner portions;

one of said wire end portions being located along one of said corner portions and the other of said wire end portions being located along the other of said corner portions.

18. The invention as defined in claim 17 and wherein:

said plug-in terminal means comprising terminal pin members; and said wire end portions being wound about and soldered to said terminal pin members.

19. The invention as defined in claim 18 and wherein:

said connector block means being made of non-conducting material and extending through and axially beyond said end wall portion of said electro-magnetic pole means into said intermediate radially extending flange portion of said housing means a sufficient distance to prevent a short circuit.

20. The invention as defined in claims 1 or 9 and wherein said retainer cover means being made of one piece of molded plastic material and being centrally rigidly adjustably connected to said drive end portion of said elongated wire housing means and having a radially outwardly extending flange portion located axially adjacent and in juxtaposition to said armature members and having an outer rim portion engaged with and rigidly supported by said electromagnetic pole means for retaining said electro-magnetic pole means on said wire housing means in abutting engagement with said intermediate radially outwardly extending flange portion and said armature members in operative association with said drive end portions of said elongated wire members and said electromagnetic pole means; and a plurality of armature retaining radially outermost slot means arranged and located on the outer rim portion of said armature retainer cover means in a circular array for receiving and retaining radially outermost portions of said armature members in operative relationship with the associated outer pole portion of the electromagnetic pole means without applying an moment of force to said armature members tending to cause pivotal movement away from the outer end surface of the inner pole portions.

21. The invention as defined in claim 20 and wherein each of said armature retaining radially outermost slot means comprising:

a pair of circumferentially spaced flange portions extending axially from the radially outwardly extending flange portions of said retaining plate means toward said outer pole portion and being abuttingly supportively engaged therewith;

said flange portions and the axially outer surface of said outer pole portion defining an armature slot therebetween; and a radially outermost portion of the associated armature member being pivotally movably mounted in and loosely confined within said armature slot in pivotally supported abutting engagement with said outer pole portion.

22. The invention as defined in claim 21 and further comprising:

adjustable fastening means connecting said retainer cover means to said drive end portion of said elongated wire housing means for enabling simulataneous equal adjustment of the air gap between each armature member and the associated one of said electromagnetic pole means without changing the location of said armature retaining radially outermost slot means relative to said outermost pole portions of said electromagnetic pole means.

23. The invention as defined in claim 20 and wherein:

each of said armature retaining slot means defining a slot of substantially non-variable cross-sectional area of a size and shape slightly larger than and corresponding to the size and shape of the radially outermost portions of said armature members received therewithin, each slot being defined by the end surface of said radially outermost pole portion and radially and axially extending non-movable surfaces on said armature retainer plate means with each of the surfaces defining said armature retaining slot means being spaced from the surfaces of the radially outermost portions of said armature members received therewithin a distance sufficient to enable operative movement of said armature members without contact therebetween; and holding means on said armature retainer plate means located in juxtaposition to each of said armature retaining slot means and being continuously engageable with said radially outermost portion of each of said armature members at a location opposite the radially outermost edge of said outermost pole portion of the associated one of said electromagnetic means for holding said radially outermost portion of each of said armature members in pivotal relationship with the radially outermost edge of said outermost pole portion without applying any moment of force thereto tending to cause rotation of the associate armature member away from said axially facing outer end surface of said radially innermost pole portion.

* * * * *